US007845360B2

(12) United States Patent
Walters et al.

(10) Patent No.: US 7,845,360 B2
(45) **Date of Patent: *Dec. 7, 2010**

(54) THERAPEUTIC STYLING BRUSH WITH INFUSION DELIVERY

(75) Inventors: Megan Walters, Canton, OH (US); Michael Defenbaugh, Marietta, GA (US); Stan Chudzik, Alpharetta, GA (US); Joni Harrison, Atlanta, GA (US); Kelly Chapman, Atlanta, GA (US)

(73) Assignee: Goody Products, Inc., Atlanta, GA (US)

( * ) Notice: Subject to any disclaimer, the term of this patent is extended or adjusted under 35 U.S.C. 154(b) by 267 days.

This patent is subject to a terminal disclaimer.

(21) Appl. No.: 11/925,301

(22) Filed: Oct. 26, 2007

(65) Prior Publication Data

US 2008/0105270 A1 May 8, 2008

Related U.S. Application Data

(60) Provisional application No. 60/863,234, filed on Oct. 27, 2006.

(51) Int. Cl.
*A45D 24/16* (2006.01)
*A45D 24/22* (2006.01)

(52) U.S. Cl. ..... 132/108; 132/112; 132/120

(58) Field of Classification Search ..... 132/112–116, 132/120, 108; 15/104.94, 104.93, 206, 160
See application file for complete search history.

(56) References Cited

U.S. PATENT DOCUMENTS

| | | | | |
|---|---|---|---|---|
| 912,719 | A | 2/1909 | McMurran | |
| 1,352,346 | A | 9/1920 | Benson | |
| 1,596,358 | A | 8/1926 | Jones | |
| 1,782,080 | A * | 11/1930 | Thomas et al. | 235/130 R |
| 1,794,130 | A * | 2/1931 | Whalen | 132/111 |
| 2,226,663 | A | 12/1940 | Hill et al. | |
| 2,547,834 | A | 4/1951 | Perwas | |
| 2,569,276 | A | 9/1951 | Baptist | |
| 2,594,721 | A | 4/1952 | Beebe | |
| 2,943,602 | A | 7/1960 | Rundle | |
| 3,833,008 | A * | 9/1974 | Blackett, Jr. | 132/313 |
| 4,370,072 | A | 1/1983 | Moffitt, Jr. | |
| 4,585,018 | A | 4/1986 | O'Connor | |
| 4,826,340 | A | 5/1989 | Rothweiler et al. | |
| 5,261,426 | A * | 11/1993 | Kellett et al. | 132/108 |
| 5,325,878 | A | 7/1994 | McKay | |
| 5,338,124 | A | 8/1994 | Spicer et al. | |
| 5,483,719 | A | 1/1996 | Ikemoto et al. | |
| 5,614,578 | A | 3/1997 | Dong et al. | |
| 5,758,984 | A | 6/1998 | Doherty | |

(Continued)

FOREIGN PATENT DOCUMENTS

EP 497080 A1 * 8/1992

OTHER PUBLICATIONS

International Search Report and Written Opinion, mailed Apr. 24, 2008, for PCT/US07/82864; 11 pgs.

*Primary Examiner*—Robyn Doan
(74) *Attorney, Agent, or Firm*—Gardner Groff Greenwald & Villanueva, PC

(57) ABSTRACT

The present invention is directed to hair styling tools having the ability to distribute a therapeutic agent into the hair via a porous material.

18 Claims, 9 Drawing Sheets

U.S. PATENT DOCUMENTS 5,813,785 A * 9/1998 Baudin et al. ..... 401/190
6,071,029 A 6/2000 Weinstock
6,745,779 B2 6/2004 Piatetsky
6,962,456 B2 11/2005 Larsen
2002/0187176 A1 12/2002 Yao
2006/0086370 A1 4/2006 O'Meara
2006/0171981 A1 8/2006 Ricahard et al.

* cited by examiner

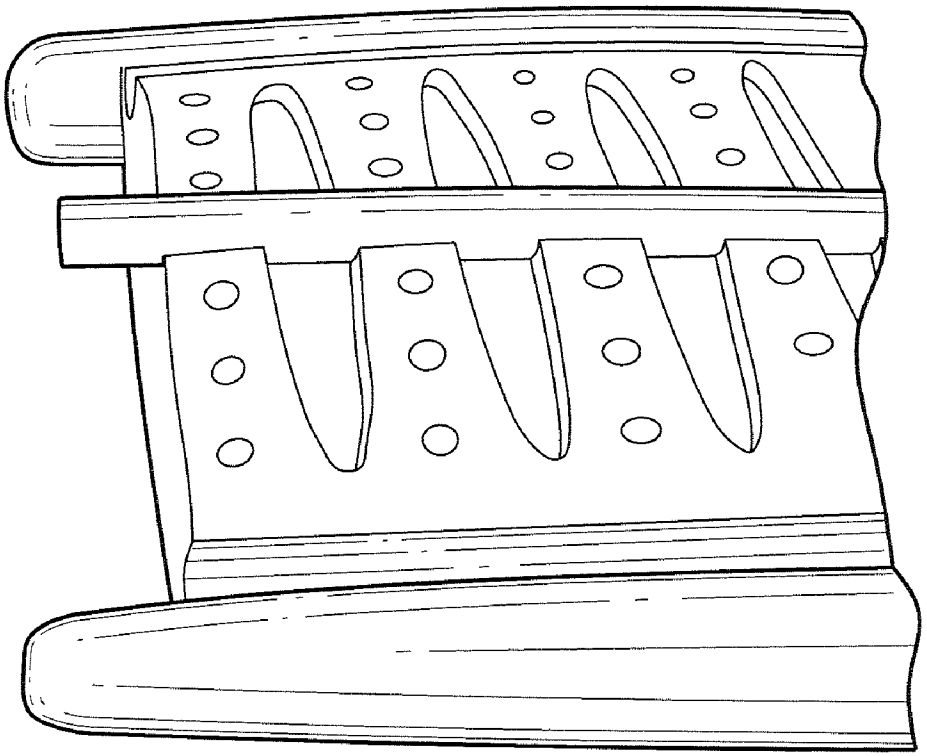
FIG. 5
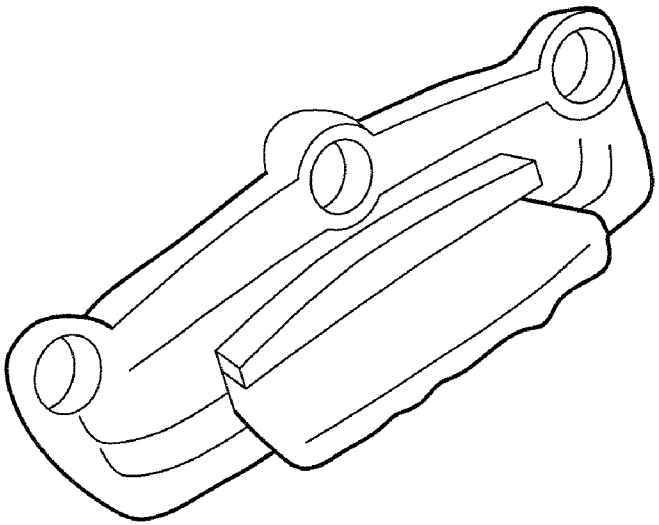

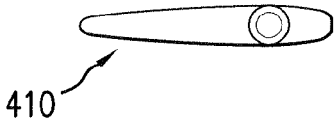
FIG.9b
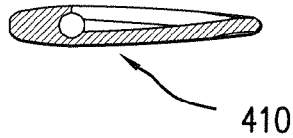
FIG.9e
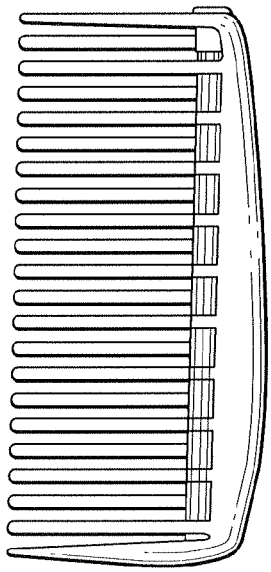
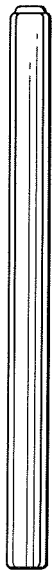
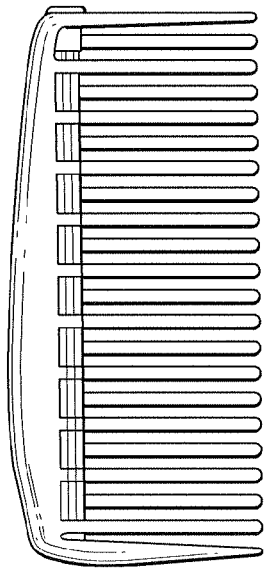
410
410
410
FIG.9a
FIG.9c
FIG.9d

THERAPEUTIC STYLING BRUSH WITH INFUSION DELIVERY

RELATED APPLICATION

This application claims the benefit of U.S. Provisional Patent Application Ser. No. 60/863,234 under 35 USC §119 or 120, filed 27 Oct. 2006, the contents of which is incorporated by reference as if fully expressed fully herein.

FIELD OF THE DISCLOSURE

The present invention is directed to hair styling tools having the ability to distribute a therapeutic agent into the hair via a porous material.

BACKGROUND OF THE DISCLOSURE

Use of brushes and/or combs to deliver therapeutic agents to the hair or skin (e.g., scalp) is generally well known in the art, as a means to treat a variety of conditions, including hair color fade, dry hair, dandruff, and the like. For example, Ikemoto et al., U.S. Pat. No. 5,483,719 discloses a brush having a replaceable rod that is placed into the head of the brush and allows delivery of a therapeutic agent to the hair, where the rod holds the therapeutic agent. However, such brushes allow for only one therapeutic agent to be delivered and the large rod is prone to having pieces break off into the user's hair. Furthermore, the design modifications necessary to protect the rod when not in use can catch in the user's hair and make the brush cumbersome to operate.

Accordingly, it can be seen that needs exist for improved delivery mechanisms for a therapeutic agent using a brush or comb without adding cumbersome or fragile structural components. It is to such solutions that the present invention is primarily directed.

SUMMARY OF THE INVENTION

The invention is directed to a hair styling tool, such as a brush or comb, having the capability to distribute a therapeutic agent via a porous material. In a specific embodiment, the styling tool may distribute more than one therapeutic agent. In various embodiments, the brush or comb has a removable and/or replaceable plastic porous material containing one or more therapeutic agents. These agents may include jojoba oil, carrot oil, tea tree oil, olive oil, ceramide, questamide, scented oil, ceramics, carbon, silver flake, salicylic acid, behentrimonium methosulfate, cetearyl alcohol, lactamide MEA, wheat amino acids, burdock root citrus bioflavinoids, meadowfoam oil, stearalkonium chloride, PVP/VA copolymer, dimethicone copolyol, cyclomethicone, polysorbate-20, chamomile extract, and birch bark extract, copper, copper oxide or lecithin.

In a related embodiment, one or more of the therapeutic agents may be replaceable/rechargeable in the porous material. In still another embodiment, the porous material may be rod-shaped and may lie parallel to the surface of the brush in a C-shaped cavity. In another aspect, the invention includes one or more of the infused porous elements (including the porous material loaded with one or more of the therapeutic agents) by themselves, which can be provided as replacement items for use on existing hairstyling tools.

BRIEF DESCRIPTION OF THE DRAWINGS

FIG. 5 shows a detailed perspective view of the end of the brush head of FIG. 4 in a disassembled state.

FIGS. 9A-9E show views of another embodiment of the present invention, in which the brush is a rake comb.

Figure 1:
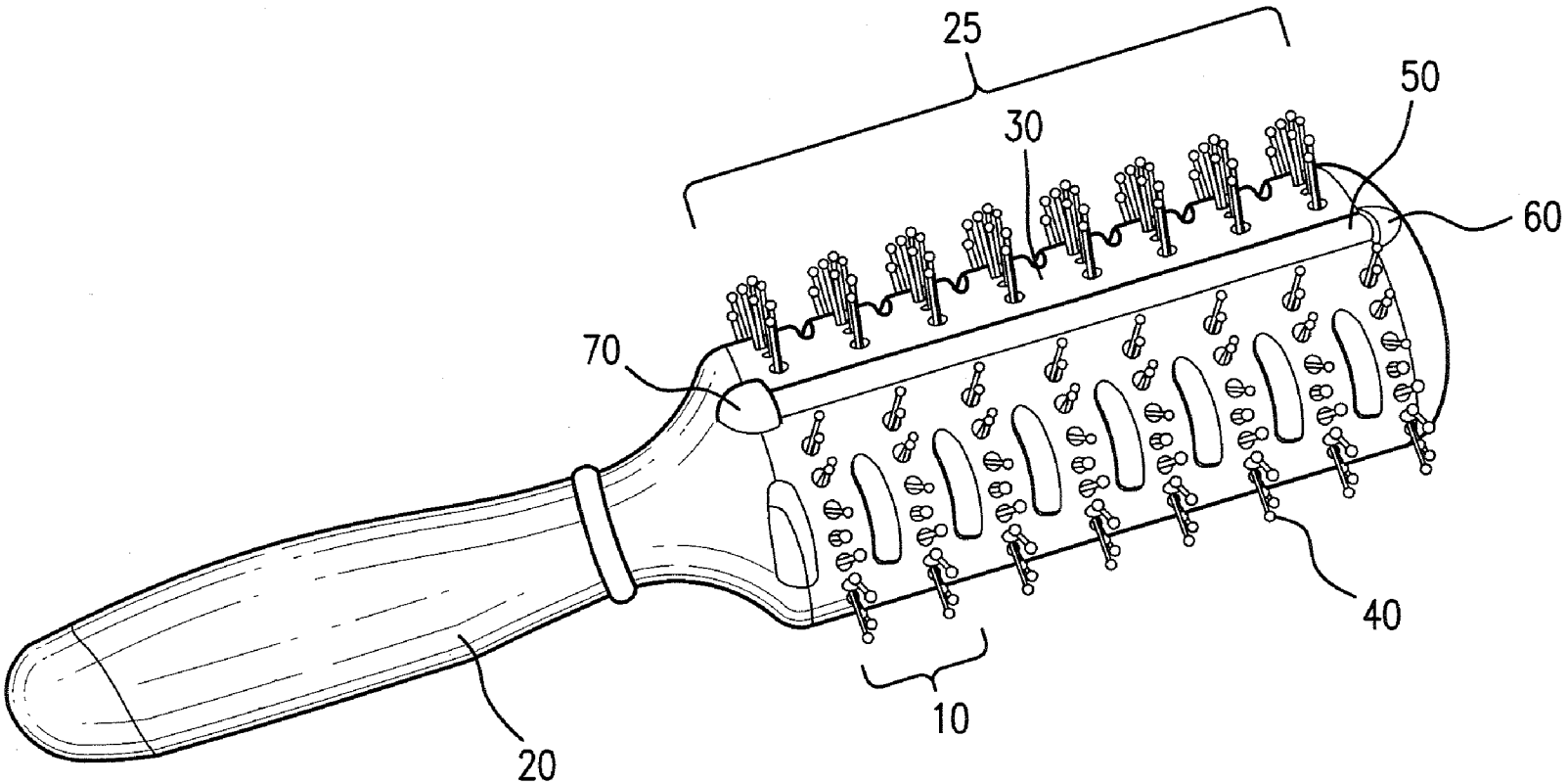
FIG. 1 is a perspective view of one embodiment of the present invention, in which the brush is a round-type brush.

While the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure.

DETAILED DESCRIPTION OF THE DISCLOSURE

Disclosed herein are hair styling tools that have the capability to distribute therapeutic agents via porous materials embedded in the styling tool, where the therapeutic agent is released or deposited when the hair is brushed. The porous material may be synthetic (e.g., a resin or plastic), metallic (e.g., metal-plated and/or alloys), and/or a natural material (e.g., cellulose).

Contemplated specific embodiments for brushes according to the present disclosure include, but are not limited to, the following:

1) a brush embedded with at least one porous material capable of distributing at least one therapeutic agent;

2) a brush having alternating or intermingled porous materials with different therapeutic agents; and 3) a brush with replaceable heads and/or porous materials (e.g., all materials replaced at one time and/or individual materials replaced individually).

As used herein, the term "therapeutic agent" means any agent capable of improving a condition of the hair and/or skin of the user. Nonlimiting examples of such agents include jojoba oil, tea tree oil, olive oil, carrot oil, ceramide, questamide, scented oils, ceramics, color protectants, antidandruff agents, antistatic agents, conditioning agents, agents that increase shine of the hair, carbon and/or other agents that decrease odor of the hair, silver flake, salicylic acid, copper oxide, and copper. Some or all of these agents may include ingredients that are heat activated, such as, for example, wax, powder, or other transitional state substances.

Conditioning agents that may be used typically fall within a group of six major categories: moisturizers, reconstructors, acidifiers, detanglers, thermal protectors, glossers, and oils, such as EFAs—essential fatty acids. Moisturizers can be concentrated with humectants or reconstructors. Humectants are compounds that attract and hold moisture into the hair. Reconstructors normally contain protein. Hydrolyzed human hair keratin protein is a preferred source of protein because it contains all 19 amino acids found in the hair. Human hair keratin protein also has a low molecular weight, which enables it to penetrate the hair shaft (the cortex). A reconstructor is often used to strengthen the hair. Nonlimiting examples of reconstructors include behentrimonium methosulfate, cetearyl alcohol, lactamide MEA, wheat amino acids, burdock root citrus bioflavinoids, meadowfoam oil, stearalkonium chloride, and lecithin.

Acidifiers may be used to create shine and add elasticity without weighing down the hair, making acidifiers important for people with fine-textured hair. Hair is elastic because of hydrogen bonds (H-bonds), which are electromagnetic bonds and may be broken by nearly any aqueous substance or compound. Hydrogen bonds are also affected by pH and electrolytes. Water breaks H-bonds and causes them to be in a "beta" state (point of greatest weakness); H-bonds devoid of most moisture arrive at an "alpha" state (point of greatest strength). Acidic solutions also add a positive electron to the bonds, creating elasticity. Electrolytic solutions such as potassium, magnesium, sodium, and many others add a positive electron to the H-bond that creates this elasticity. Behentrimonium Methosulfate, Cetearyl Alcohol, Lactimide MEA, Panthenol, Wheat Amino Acids, Burdock Root, Citrus Bioflavinoids, Meadowfoam Oil, Stearealkonium Chloride, Lecithin, are possible ingredients for Acidifiers.

Detanglers are typically acidifiers with a low pH of about 2.5 to about 3.5. They close the cuticle of the hair, which prevents tangles. Wheat protein, botanicals, and lipids are examples of detanglers. Some detanglers "shield" the hair shaft with polymers. Most detanglers are categorized as acidifiers due to their lower pH value but may also contain polymers that prevent individual hairs from tangling up with one another. Additives such as silicone and propylene glycol allow the hair to avoid tangling. Some detanglers are instant, while others may need about 1-5 minutes to be effective.

Thermal protectors safeguard the hair against heat. Use of thermal protectors is of particular importance in instances where hair is exposed to heat from hairdryers, curling irons, flat irons, hot rollers or similar techniques. Thermal protectors are normally heat absorbent polymers that distribute heat to minimize heat damage to hair. Nonlimiting examples of thermal protectors include PVP/VA copolymer, dimethicone copolyol, cyclomethicone, polysorbate-20, chamomile extract, and birch bark extract.

Glossers typically contain dimethicone or cyclomethicone. Used in small amounts, glossers reflect light and/or can control "frizzies." A nonlimiting example of a glosser includes oils (EFAs), as they are similar in nature to the scalp's sebum (natural oil secretion of the scalp), and sebum contains EFAs. Dry hair, especially dry hair due to chemical treatment of the hair, e.g., hair color, perms, and relaxers, typically is lacking in natural oils or sebum. EFAs can transform very dry and porous hair into soft pliable hair. Vanilla bean is an example of this conditioner type.

The amount of therapeutic agent loaded into the porous material is selected based on the type of agent, the desired end use, expected useful life, expected time from manufacture to sale, and the like. In addition, the amount of therapeutic agent that can be loaded into the porous material is limited by the porosity and total volume of each section or piece of the porous material. In a typical commercial embodiment the porous material has a porosity of about 40% (meaning it is about 40% air by volume), so the amount of therapeutic agent that could be loaded into the porous material would be about 40% by volume of the porous material. In other embodiments the porous material has a porosity of about 30% to about 90%, so the amount of therapeutic agent that could be loaded into the porous material would be within that range. In still other embodiments the porous material has a porosity of about 5% to about 90%, though the amount of therapeutic agent that is loaded into the porous material is preferably of about 5% to about 40%.

In an application filed simultaneously herewith the same title and priority claim, which application is incorporated herein by reference in its entirety, styling tools with therapeutic agents in the bristles were disclosed. The present application is used preferably for styling situations in which heat is used. For example, if a blow dryer is used, pads associated with bristles may melt. For this reason, styling tools with porous materials may be used in many situations, but the primary heat styling brushes, such as hot rounds and vented, are logical uses.

Styling tools using the disclosed porous materials are preferably injection molded, as the tools themselves may be made of plastic. Wooden styling tools may also be produced. Porous materials may be obtained from Micropore (Atlanta, Ga. USA) or Porex (Duluth, Ga. USA). The porous plastic material may be any thermoplastic polymer with the ability to distribute a liquid or transitional-state substance, preferably in the PE family. Materials such as high density polyethylene, ultra-high molecular weight polyethylene, low density polyethylene, polypropylene, polycarbonate, polyvinylidine difluoride, ethylene vinyl acetate and hermoplastic polyurethane may be used. The minimum pore size is preferably about 5 microns (μm). There is no maximum, though at some point the pore size could become too large to effectively retain the therapeutic agent. In a particular embodiment, ultra-high molecular weight polyethylene with a 35 μm pore size may be used.

The porous material in the present invention may be formed from any conventional porous material. However, in one aspect, the porous material is a sintered porous material, such as a sintered porous thermoplastic material. Some suitable base materials that may be used to provide the porous thermoplastic substrate are described in U.S. Pat. No. 6,551,608 to Yao and pending U.S. Published Application No. U.S. 2003-0062311-A1, both of which are incorporated herein by reference in their entirety. Suitable thermoplastics for use in forming the porous material of the present invention include, but are not limited to, polyolefins, nylons, polycarbonates, poly (ether sulfones), and mixtures thereof, as well as fluoropolymers, such as pvdf and ptfe. A preferred thermoplastic is a polyolefin. Examples of preferred polyolefins include, but are not limited to: ethylene vinyl acetate; ethylene methyl acrylate; polyethylenes; polypropylenes; ethylene-propylene rubbers; ethylene-propylenediene rubbers; poly (1-butene); polystyrene; poly (2-butene); poly (1-pentene); poly (2-pentene); poly (3-methyl-1-pentene); poly (4-methyl-1-pentene); 1,2-poly-1,3-butadiene; 1,4-poly-1,3-butadiene; polyisoprene; polychloroprene; poly (vinyl acetate); poly (vinylidene chloride); and mixtures and derivatives thereof. A preferred polyolefin is polyethylene. Examples of suitable polyethylenes include, but are not limited to, low density polyethylene, linear low density polyethylene, high density polyethylene, ultra-high molecular weight polyethylene, and derivatives thereof. In alternative embodiments the material may also be composed of or formed from sintered metal, steel mesh, woven metal, ceramic materials, non-woven materials, bi-component, continuous, or staple fiber media using an extrusion or pultrusion process.

Examples of polyolefins suitable for use in the invention include, but are not limited to: ethylene vinyl acetate (EVA); ethylene methyl acrylate (EMA); polyethylenes such as, but not limited to, low density polyethylene (LDPE), linear low density polyethylene (LLDPE), high density polyethylene (HDPE), and ultra high molecular weight polyethylene (UH- MWPE); polypropylenes; ethylene-propylene rubbers; ethylene-propylene-dyne rubbers, poly (1-butene); polystyrene; poly (2-butene); poly (1-pentene); 1,2-poly-1,3-butadiene; 1,4-poly-1,3-butadiene; polyisoprene; polychloropene; poly (vinyl acetate); poly (vinylidene chloride); and mixtures and derivatives thereof.

Sinterable thermoplastics other than those recited herein can also be used in this invention. As those skilled in the art will appreciate, the ability of a thermoplastic to be sintered can be determined from its melt flow index (MFI). Melt flow indices of individual thermoplastics are known or can be readily determined by methods well known to those skilled in the art. For example, an extrusion plastometer made by Tinius Olsen Testing Machine Company, Willow Grove, Pa. can be used. The MFIs of thermoplastics suitable for use in this invention will depend on the particular porous thermoplastic material and/or the method used to prepare it. In general, however, the MFI of a thermoplastic suitable for use in the materials and methods of the invention is from about 0 to about 15. The temperatures at which individual thermoplastics sinter (i.e., their sintering temperatures) are also well known, or can be readily determined by routine methods such as, but not limited to, thermal mechanical analysis and dynamic mechanical thermal analysis.

The characteristics of a sintered porous material can depend on the average size and distribution of the particles used to make it as well as the particles' average shape. In one aspect of the invention, the thermoplastic particles are substantially spherical. This shape provides certain benefits. First, it facilitates the efficient packing of the particles within a mold. Second, substantially spherical particles, and in particular those with smooth edges, tend to sinter evenly over a well defined temperature range to provide a final product with desirable mechanical properties and porosity. Typical pore size starting approximately at 5 μm and up to approximately 500 μm is preferred; however, smaller and larger pore sizes are also possible. For example, the pore sizes can be as low as about 1 μm and as high as about 500 μm, whereas, the porosity can be as low as about 30% and as high as about 90%. Producing porous material with a predetermined pore size and porosity is known to those of ordinary skill in the art and can vary the depending on the process used and/or the starting material selected.

Preferably, a rod or cylinder is molded from sintered porous plastic material. According to an embodiment of the invention a mold having a desired configuration can be filled with sintered porous plastic precursor composition, such as for example, a powder batch, and the particles can be fused together by heating to form the resulting rod or cylinder in the shape of the mold. The particular sintering conditions are known in the art and will depend, in part, upon the particular sintered porous plastic precursor composition. To this end, one of skill in the art will be able to determine the particular sintering conditions without requiring the undue experimentation. Because of such molding process, any desired shape, configuration, or dimensions may be readily formed from a porous material in one continuous and contiguous piece.

The particles used to form the porous plastic to be sintered can be formed by several processes known in the art. One such process is cryogenic grinding. Cryogenic grinding can be used to prepare thermoplastic particles of varying sizes. But because cryogenic grinding provides little control over the sizes of the particles it produces, powders are formed using this technique may be screened to ensure that the particles to be sintered are of a desired average size and size distribution.

Underwater pelletizing can also be used to form thermoplastic particles suitable for sintering. Although typically limited to the production of particles having diameters of greater than about 36 μm, underwater pelletizing offers several advantages. First, it provides accurate control over the average size of the particles produced, in many cases thereby eliminating the need for an additional screening step and reducing the amount of wasted material. A second advantage of underwater pelletizing, which is discussed further herein, is that it allows significant control over the particles' shape.

Figure 2:
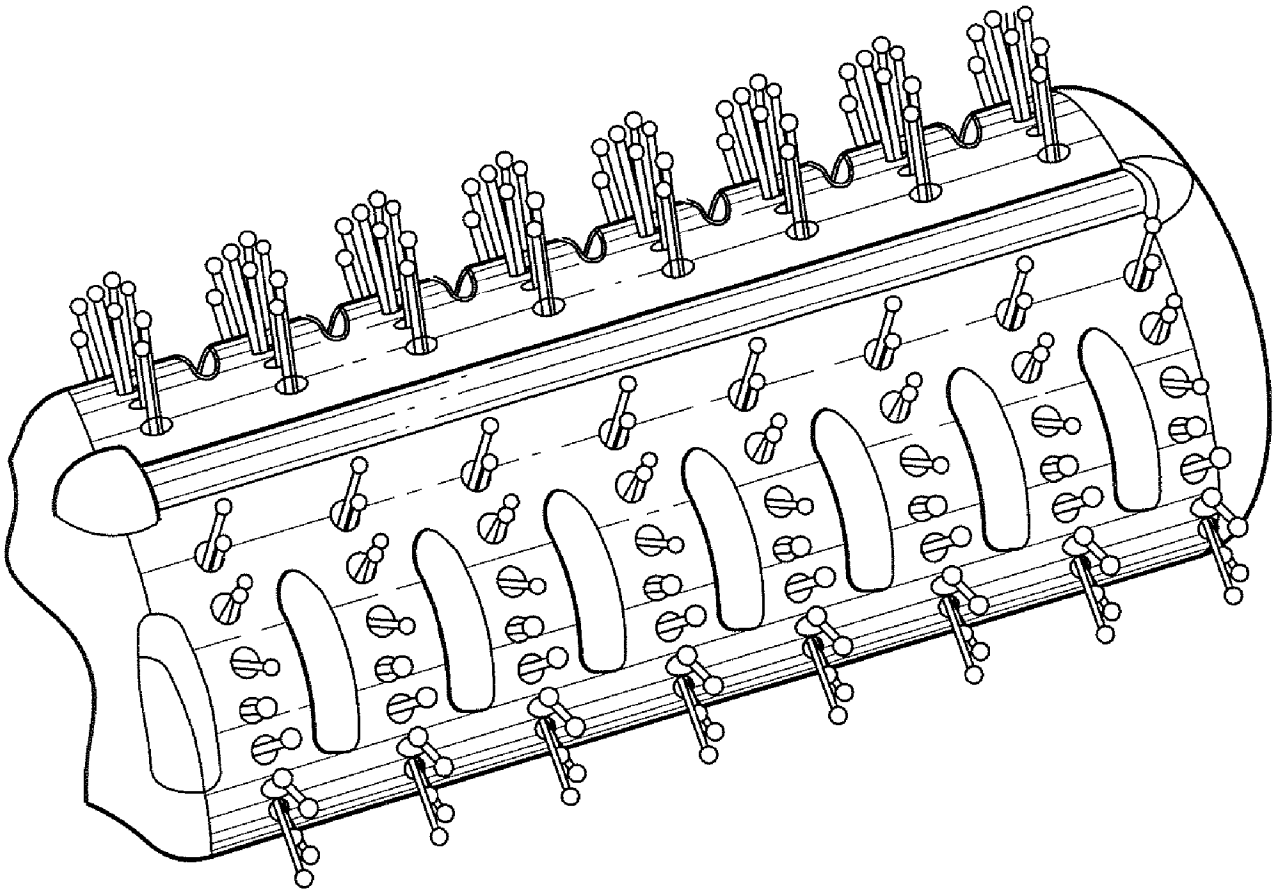
FIG. 2 shows a detailed perspective view of the brush head of FIG. 1.
Figure 3:
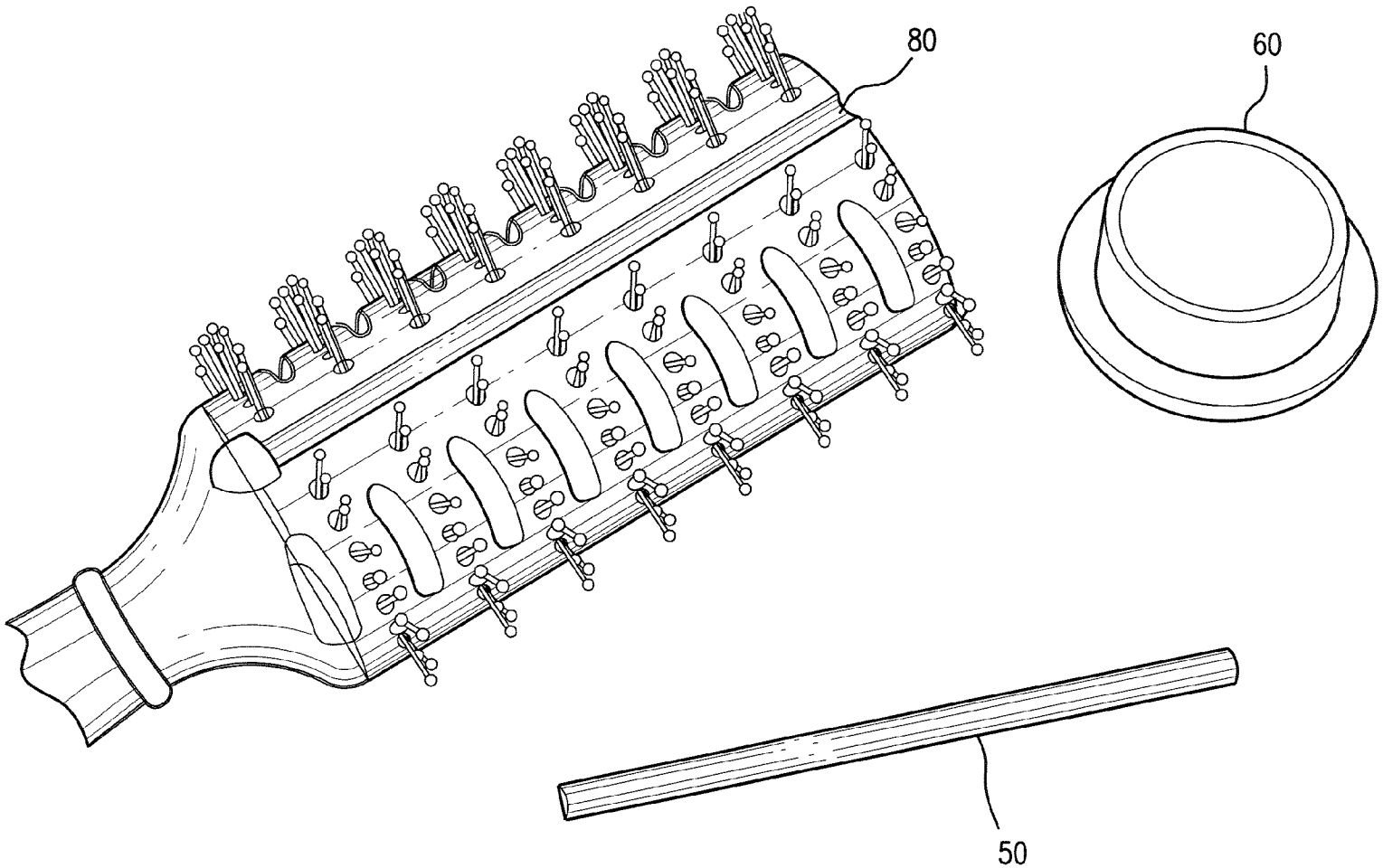
FIG. 3 shows the brush of FIG. 1 in a disassembled state.

Referring to FIGS. 1-3, one embodiment of the present invention is shown, in which the styling tool is a round-type brush 10. The brush 10 preferably includes a handle 20 and a brush head 30. The brush head may be comprised of bristles 40 and a porous material 50.

In the depicted embodiment, the porous material 50 may be a plastic, and may be in the shape of an elongate cylinder or rod. In other embodiments, the porous material may be formed into other shapes, such as knobs, strips or the like. The styling tool may have indentations, channels, or other cavities 80 in the brush head 30 that receive and/or grip the piece of porous material 50. For example, these indentations 80 may be of a C-shape that generally conforms to the profile of the porous material rods 50 and receives them with a loose fit, with the brush including retaining elements that hold the rods within the indentations, so that the rods are free to rotate and dispense therapeutic agent as the brush is rotated during styling. Additionally or alternatively, the indentations 80 may be curved in an arc of over 180 degrees, so that at the surface of the brush head each well is narrowed to form opposing retaining elements that keep the cylinder or rod in place within the indentation on the face of the brush head. These embodiments may include other retaining elements to "trap" the ends of the rods 50, such as retainer wells 70. In one embodiment, the styling tool may have a removable brush cap 60 with a retainer well 70 that will trap the top end of the rods 50. In such an embodiment the cap may be removed to replace the porous material rod 50. For example, a silicone ring/friction fit may be used to attach the brush cap 60 to the round-type styling tool or brush, as shown in FIG. 3. Alternatively, detents, other snap-fit couplings, screw-on couplings, or other conventional removable coupling structures may be used to removably secure the brush cap 60 to the brush head 30.

In the embodiment shown in FIG. 3, the porous plastic material is in the shape of a rod or cylinder. In this embodiment, the rod or cylinder may sit parallel to the surface of the brush head and be arranged coaxially with the brush. Slightly less than half of the rod or cylinder may be exposed to deliver the therapeutic agent. In a related embodiment, each brush may have between two and six rods per styling tool. In still another embodiment, a styling tool may have three rods. In an embodiment in which the styling tool is a comb, the comb may have at least 1 cylinder or rod. In embodiments with a plurality of the rods or other-shaped porous material pieces, the rods may be spaced apart around the brush head in a parallel arrangement with sections of bristles between them, or some or all of the rods may be placed closely together. In other embodiments, the porous material is formed into one or more strips, rods, or other-shaped pieces having a curvature generally conforming to that of the brush head and they are arranged laterally around the brush head (instead of coaxially). In yet other embodiments, flat strips of the porous material are removably mounted to the brush, bristles extend from the flat strips, and the strips and the bristles are treated with one or more of the therapeutic agents. In other embodiments, the brush is provided with retaining elements to secure the rods to the surface of the brush head, without the need for the indentations, to expose a larger surface area of the rods to the hair during styling and to thereby dispense more of the therapeutic agent into the hair.

Figure 4:
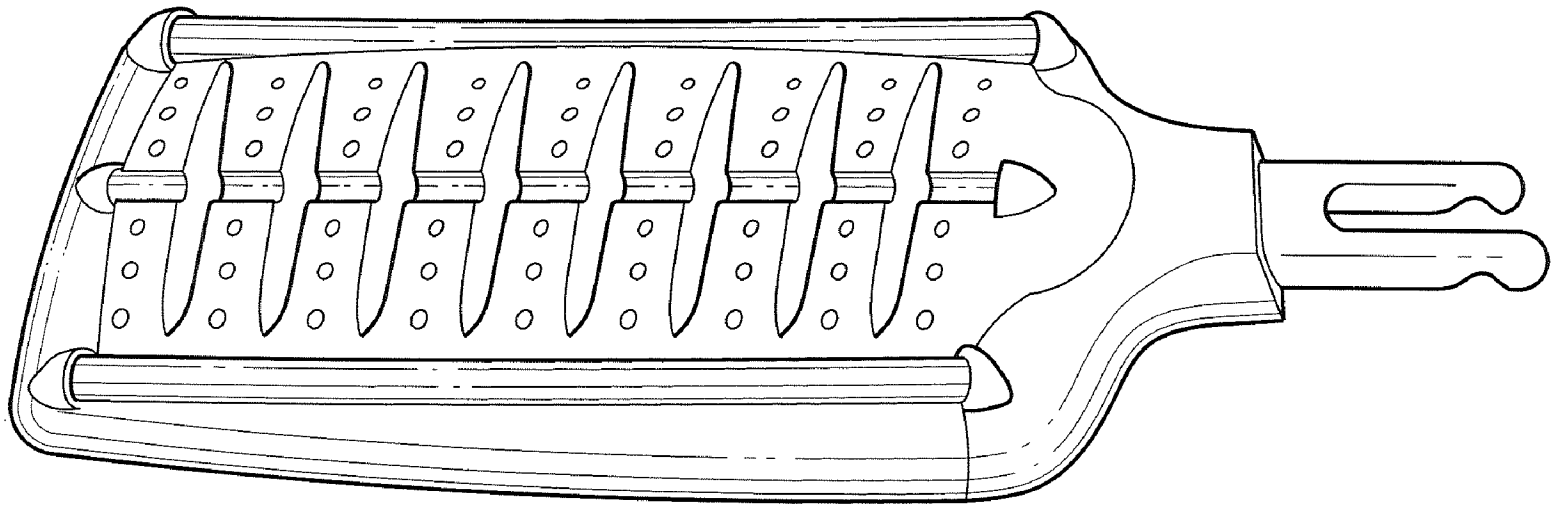
FIG. 4 is a perspective view of another embodiment of the present invention in which a vent-style brush head is shown without bristles.
Figure 6:
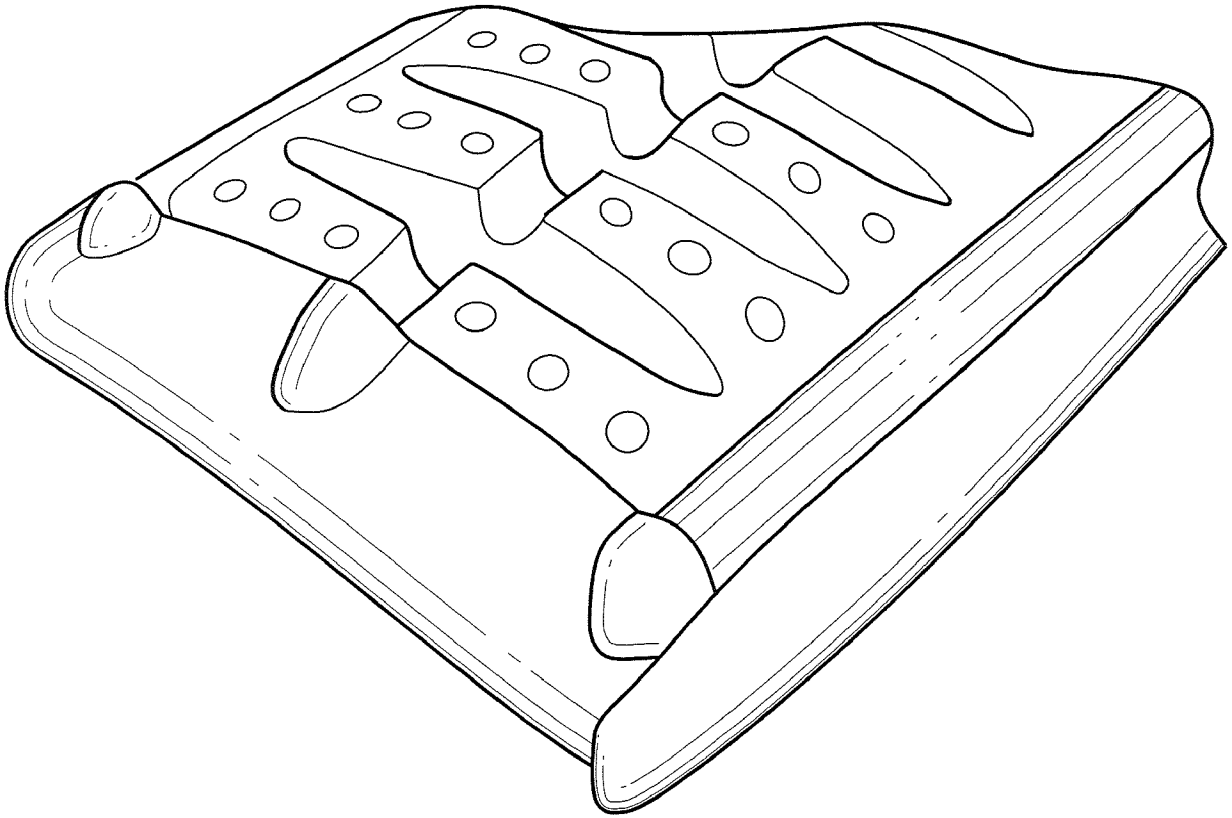
FIG. 6 shows a detailed perspective view of the end of the brush head shown in FIG. 4.
Figure 7B:
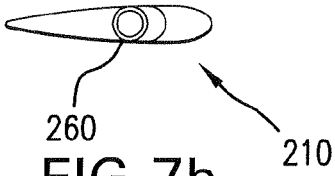
FIGS. 7A-7E show views of another embodiment of the present invention, in which the brush is a rattail comb.
Figure 7E:
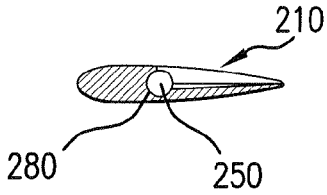
Figure 7A:
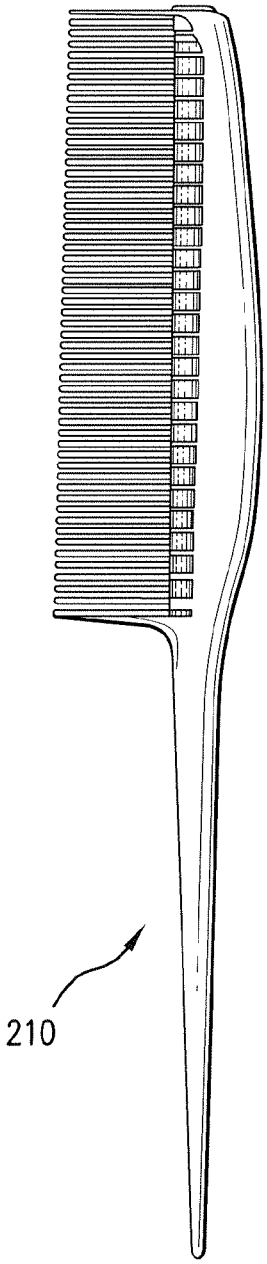
Figure 7C:
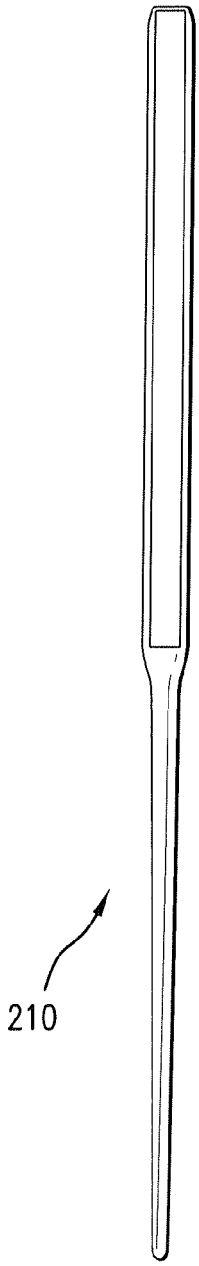
Figure 7D:
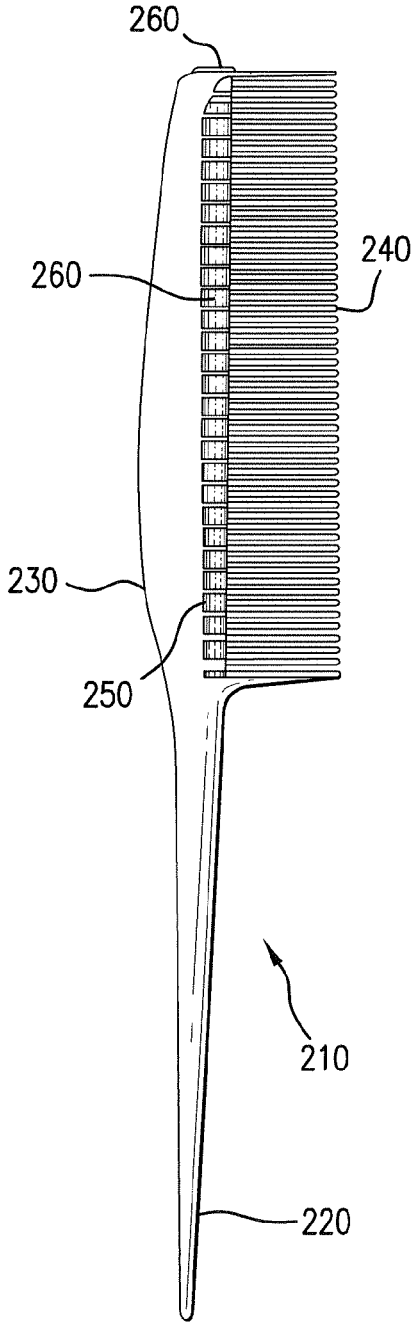
Figure 8B:
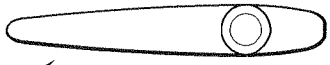
FIGS. 8A-8D show views of another embodiment of the present invention, in which the brush is a handle comb.
Figure 8D:
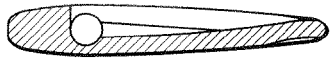
Figure 8A:
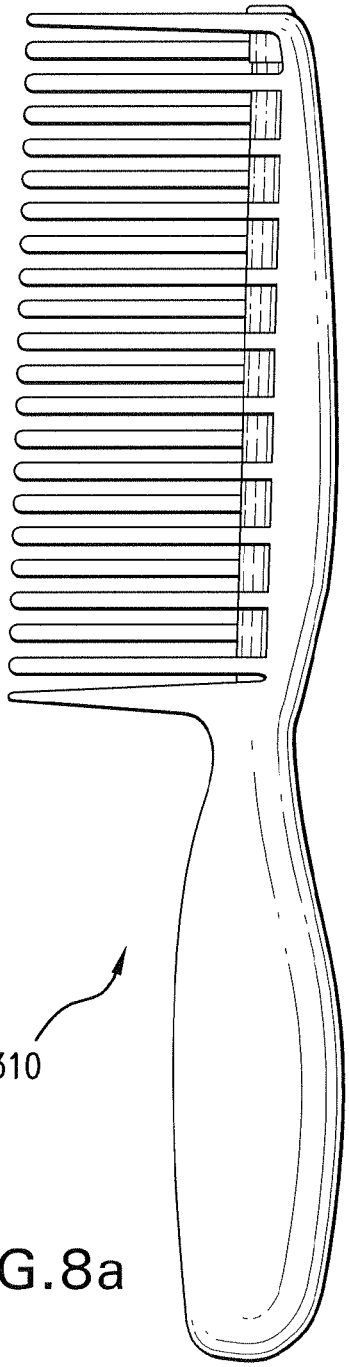
Figure 8C:
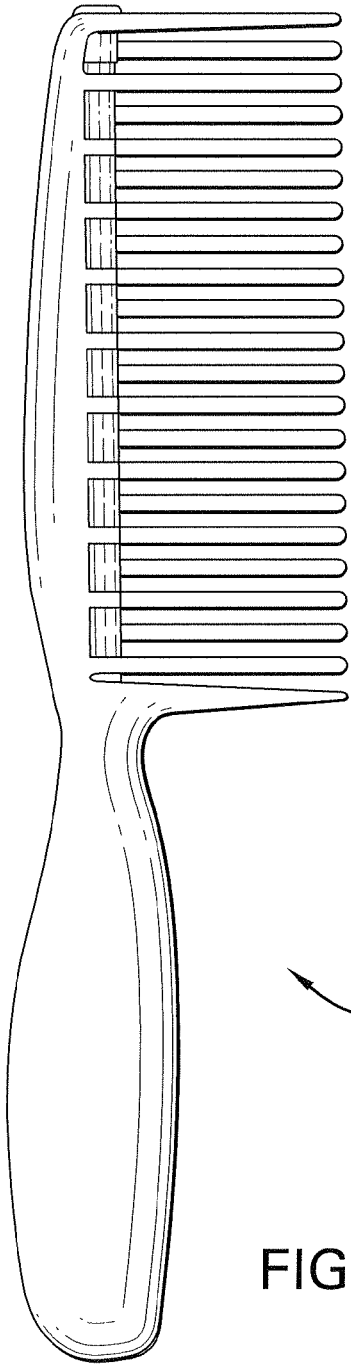

Referring to FIGS. 4-6, another embodiment of the present invention is shown, in which the styling tool is a vent-type brush 110. Similarly to the embodiment of FIGS. 1-3, the brush 110 preferably includes a handle 120 and a brush head 130 with bristles (not shown), a porous material 150, and a cap 160. In this embodiment, there are three porous material rods 150 treated with one or more therapeutic agents and removably mounted in indentations, channels, or other cavities 180 of the brush head 130. Retaining elements 170 are included in the brush head 130 and the snap-fit brush cap 160, which can be removed to replace the porous plastic material rods 150 when they are depleted of therapeutic agent. For example, the brush cap 160 may be removed from the brush head 130, the used rods 150 may be slid out, new rods may be slid into the C-shaped channels, and the brush cap replaced.

Referring to FIGS. 7A-7E, still another embodiment of the present invention is shown, in which the styling tool is a rattail comb 210. Similarly to the embodiments described above, the comb 210 preferably includes a handle 220 and a head 230 with teeth 240 and a porous material 250. In this embodiment, the porous material 250 is formed into a section such as the depicted rod that is received in a channel 280 formed in the comb head 230. The channel 280 is preferably formed at the base of the teeth 240, where they extend from the comb head 230. The teeth 240 are preferable staggered, with every other tooth to the front or back and the channel 280 routed between them, so that the teeth capture the porous rod 250 from the front and back. In addition, the base of the teeth 240 have a thinner section partially defining the channel 280 for the porous rod 250 and a thicker section that captures and retains the rod from the side. In this way, the porous rod 250 is prevented from dislodging from the comb 210. Furthermore, the channel 280 extends through the top end of the comb head 230 so that the porous rod 250 can be inserted into and removed from the channel therethrough. And a cap 260 on the top end of the porous rod 250 removably mates to the top end of the comb head 230 so that the rod is held in place for use and so that when spent the rod can be removed and replaced with a fresh one. The cap 260 removably mates to the comb head 230 by a snap-fit structure, mating threads, or other conventional couplings. The cap 260 can be integrally mounted or formed on the rod (with replacement rods 250 including a new cap), or removably mounted on the rod with a friction fit or other conventional coupling structure.

Referring to FIGS. 3 8A-8D, another embodiment of the present invention is shown, in which the styling tool is a handle comb 310. And referring to FIGS. 9A-9E, yet another embodiment of the present invention is shown, in which the styling tool is a rake comb 410.

In another aspect, the invention includes one or more of the infused porous elements 50 (including the porous material infused with one or more of the therapeutic agents) by themselves, which can be provided as replacement items for use on existing hairstyling tools. The infused porous elements 50 can be packaged individually or in a set and sold for use with any of the hairstyling tools described above or with other hairstyling tools. In this way, upon the depletion of the therapeutic agent in the infused porous elements 50 originally provided on a hairstyling tool, the user can purchase more infused porous elements by themselves and replace them on the tool. Or the infused porous elements 50 and the hairstyling tools can be sold separately, with various models of the infused porous elements containing different therapeutic agents, so that users can select the hairstyling tool and the infused porous element that best suit their needs, and subsequently mount the selected infused porous elements onto the selected tool for use.

The infused porous elements 50 each include a body that is made of a porous material, infused with at least one therapeutic agent, and formed into a shape and size for mounting onto a hair styling tool, as described above. In the embodiment depicted in FIG. 3, the body of the infused porous element has the shape of a rod. Preferably, the rods have a length that is substantially the same as or slightly less than the length of the head of the hair styling tool they are mounted onto, with the size of the rods relative to the size of the tool heads preferably along the lines of what is depicted in the various drawing figures. In typical commercial embodiments, for example, the rods have a length of about 3 to 5 inches and a diameter of about 1/16 to 1/4 inches. In alternative embodiments, the infused porous elements 50 have bodies with other sizes and shapes, for example, strips, knobs, and the like, as mentioned above.

While the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

We claim:

1. A hair styling tool, comprising:

a head defining a front surface;

one or more sections of a semi-rigid or rigid porous polyolefin plastic material replaceably mounted to the front surface of the head, wherein the sections of porous material are sintered from a plurality of plastic particles, wherein the sections of porous material have a porosity of about 5% to 90%;

one or more bristles extending from the front surface of the head; and two or more therapeutic agents, wherein the agents are distributed to a user's hair through the one or more sections of porous material of the head by capillary action without being pressurized by a propellant, wherein the therapeutic agent is two or more materials selected from the group comprising jojoba oil, carrot oil, tea tree oil, olive oil, ceramide, questamide, scented oil, ceramics, carbon, silver flake, salicylic acid, behentrimonium methosulfate, cetearyl alcohol, lactamide MEA, wheat amino acids, burdock root citrus bioflavinoids, meadowfoam oil, stearalkonium chloride, PVP/VA copolymer, dimethicone copolyol, cyclomethicone, polysorbate-20, chamomile extract, and birch bark extract, copper, copper oxide and lecithin.

2. The tool of claim 1, wherein the one or more section of porous material is rod shaped and lies parallel to the front surface of the brush head.

3. The tool of claim 1, wherein the tool is a brush or a comb.

4. A hair styling tool, comprising:

a brush head including a main body and a displaceable endcap, the main body having a front surface defining an elongate channel cavity and a first retainer well at a first end of the elongate cavity and the displaceable endcap defining a second retainer well that is positioned at a second end of the elongate cavity when the endcap is mounted to the main body for use;

one or more sections of a semi-rigid or rigid porous polyolefin material, wherein the section of porous material is elongate, replaceably mounted to the front surface of the head, and lies parallel to the front surface of the brush in the elongate cavity, wherein the section of porous material is received within the elongate cavity and the first and second retainer wells and retained there by the first and second retainer wells when the endcap is mounted to the main body for use, and wherein the section of porous material is removable from the elongate cavity and the first retainer well when the endcap is displaced from the main body;

one or more bristles that extend from the front surface of the brush head; and two or more therapeutic agents, wherein the therapeutic agents are distributed to a user's hair through said one or more sections of porous material of the brush head by capillary action without being pressurized by a propellant, where the therapeutic agent is two or more materials selected from the group comprising jojoba oil, carrot oil, tea tree oil, olive oil, ceramide, questamide, scented oil, ceramics, carbon, silver flake, salicylic acid, behentrimonium methosulfate, cetearyl alcohol, lactamide MEA, wheat amino acids, burdock root citrus bioflavinoids, meadowfoam oil, stearalkonium chloride, PVP/VA copolymer, dimethicone copolyol, cyclomethicone, polysorbate-20, chamomile extract, and birch bark extract, copper, copper oxide and lecithin.

5. The tool of claim 4, wherein the elongate section of porous material is rod-shaped and the elongate cavity is C-shaped.

6. An article for mounting onto a hairstyling tool to treat hair, the hair-treating article comprising:

a body made of a semi-rigid or rigid porous polyolefin material and adapted to removably mount to the hairstyling tool, wherein the porous-material body is sintered from a plurality of plastic particles, wherein the porous material has a porosity of about 5% to 90%; and at least two therapeutic agents carried by the porous-material body and selected for treating the hair, wherein the therapeutic agents are dispensed from the porous-material body to the hair by capillary action without being pressurized by a propellant when at least a portion of the hairstyling tool is moved through the hair to style the hair, wherein the therapeutic agent is selected from the group consisting of moisturizers, reconstructors, acidifiers, detanglers, thermal protectors, and glossers, wherein the therapeutic agent comprises two or more materials selected from the group comprising jojoba oil, carrot oil, tea tree oil, olive oil, ceramide, questamide, scented oil, ceramics, carbon, silver flake, salicylic acid, behentrimonium methosulfate, cetearyl alcohol, lactamide MEA, wheat amino acids, burdock root citrus bioflavinoids, meadowfoam oil, stearalkonium chloride, PVP/VA copolymer, dimethicone copolyol, cyclomethicone, polysorbate-20, chamomile extract, and birch bark extract, copper, copper oxide and lecithin.

7. The hair-treating article of claim 6, wherein the hairstyling tool includes a head, wherein the porous-material body is removably mountable to the head.

8. The hair-treating article of claim 6, wherein the porous-material body is rod-shaped.

9. The hair-treating article of claim 6, wherein the porous material has a minimum pore size of about 5 microns.

10. The hair-treating article of claim 9, wherein the porous material has a pore size of about 35 microns.

11. The hair-treating article of claim 1, wherein the porous material has a porosity of about 40%.

12. The hair-treating article of claim 6, wherein the porous plastic material includes a polyethylene material.

13. The hair-treating article of claim 12, wherein the porous material is selected from the group consisting of high density polyethylene, ultra-high molecular weight polyethylene, low density polyethylene, polypropylene, polycarbonate, polyvinylidine difluoride, ethylene vinyl acetate, and hermoplastic polyurethane.

14. The hair-treating article of claim 12, wherein the plurality of plastic particles each have a substantially spherical shape.

15. The hair-treating article of claim 6, wherein the plastic particles are made by cryogenic grinding or underwater pelletizing.

16. An article for mounting onto a hairstyling tool to treat hair, the hair-treating article comprising:

a body made of a semi-rigid or rigid porous polyolefin material and adapted to removably mount to the hairstyling tool, wherein the porous polyolefin material includes a polyethylene material selected from the group consisting of high density polyethylene, ultra-high molecular weight polyethylene, low density polyethylene, polypropylene, polycarbonate, polyvinylidine difluoride, ethylene vinyl acetate, and hermoplastic polyurethane, wherein the porous-material body is sintered from a plurality of plastic particles each having a substantially spherical shape, wherein the plastic particles are made by cryogenic grinding or underwater pelletizing, wherein the porous material has a porosity of about 35% and a pore size of about 35 microns; and at least two therapeutic agents carried by the porous-material body and selected for treating the hair, wherein the therapeutic agents are dispensed from the porous-material body to the hair by capillary action without being pressurized by a propellant when at least a portion of the hairstyling tool is moved through the hair to style the hair, wherein the therapeutic agent is selected from the group consisting of moisturizers, reconstructors, acidifiers, detanglers, thermal protectors, and glossers, wherein the therapeutic agent comprises two or more materials selected from the group comprising jojoba oil, carrot oil, tea tree oil, olive oil, ceramide, questamide, scented oil, ceramics, carbon, silver flake, salicylic acid, behentrimonium methosulfate, cetearyl alcohol, lactamide MEA, wheat amino acids, burdock root citrus bioflavinoids, meadowfoam oil, stearalkonium chloride, PVP/VA copolymer, dimethicone copolyol, cyclomethicone, polysorbate-20, chamomile extract, and birch bark extract, copper, copper oxide and lecithin.

17. The hair-treating article of claim 16, wherein the hairstyling tool includes a head, wherein the porous-material body is removably mountable to the head.

18. The hair-treating article of claim 16, wherein the porous-material body is rod-shaped.

* * * * *